United States Patent [19]

Dennis

[11] Patent Number: 4,872,680

[45] Date of Patent: Oct. 10, 1989

[54] ELECTRIC DRAG STRIP APPARATUS

[76] Inventor: Willard A. Dennis, P.O. Box 807 Country Club Dr., Johnsonville, S.C. 29555

[21] Appl. No.: 279,513

[22] Filed: Dec. 5, 1988

[51] Int. Cl.[4] ..... A63F 9/14

[52] U.S. Cl. ..... 273/86 B; 238/10 F; 446/446

[58] Field of Search ..... 273/86 B; 238/10 F; 446/429, 430, 446

[56] References Cited

U.S. PATENT DOCUMENTS

| | | | |
|---|---|---|---|
| 3,315,632 | 4/1967 | Hyden | 273/86 B X |
| 3,339,307 | 9/1967 | Floyd et al. | 273/86 B X |
| 3,403,908 | 10/1968 | Sheldon et al. | 273/86 B |
| 3,411,782 | 11/1968 | Wood | 273/86 B |
| 3,565,430 | 2/1971 | McRoskey | 273/86 B |
| 3,589,055 | 6/1971 | Stormon | 446/229 X |
| 3,702,037 | 11/1972 | Toy et al. | 446/229 X |
| 3,750,328 | 8/1973 | Nielsen et al. | 446/429 |
| 3,986,717 | 10/1976 | Kirby et al. | 273/86 B |

*Primary Examiner*—Anton O. Oechsle
*Attorney, Agent, or Firm*—Leon Gilden

[57] ABSTRACT

An electric drag strip apparatus is set forth wherein the organization includes the various features associated with the sport of "drag racing". Initially a "burn-out" area is provided wherein a plurality of troughs are positioned on either side of elongate guide slots and electrical contact strips wherein the troughs are filled with a fluid, such as water and the like, to simulate a "burn-out" area in a drag strip. A sequencing light arrangement is positioned at a starting line wherein a plurality of solenoid actuated flags indicate a winner wherein the flags are operated by means of a photo-electric eye positioned at the finish line of the drag strip. Further, a parachute docking arrangement is positioned adjacent and beyond the finish line to secure to an associated miniature car to simulate the analogous event at a drag strip.

8 Claims, 5 Drawing Sheets

ELECTRIC DRAG STRIP APPARATUS

BACKGROUND OF THE INVENTION

1. Field of the Invention

The field of invention relates to amusement apparatus, and particularly pertains to a new and improved electric drag strip apparatus to simulate events occurring in the sport of "drag racing".

2. Description of the Prior Art

The availability of simulation toys for simulating sporting events is well known in the prior art. Particularly in the sport of "drag racing" availability of an amusement device to fully simulate the various events that occur in the contemporary drag racing event has heretofore not been available. For example, U.S. Pat. No. 3,339,307 to Floyd, et al., sets forth a simulation oval track racing game wherein a player may utilize simulation controls to effect control over a vehicle utilized in participating in the race. The device, however, while not simulating a drag racing event, does in fact attempt to simulate an oval track racing event but lacks the details of such an event as the instant invention tends to provide in the drag racing event.

U.S. Pat. No. 3,315,632 to Hyden sets forth a finish line indicator organization actuated by respective linkage arrangements to provide a mechanical indication of a winner in an amusement simulation type toy. The device of Hyden is of interest but removed from the instant invention utilizing a photoelectric eye to avoid mechanical interference with the speed of a finishing miniature vehicle to enable utilization of the parachute arrangement utilized by the instant invention.

U.S. Pat. No. 3,403,908 to Sheldon, et al., sets forth a drag strip arrangement to simulate a sporting event wherein a sequencing starting light arrangement is set forth and wherein the vehicles are manipulated by means of rearwardly positioned gear shifting arrangements.

U.S. Pat. No. 3,411,782 to Wood sets forth a starting device utilizing a suction cup to control the position of a bar extendable across a track such that a lower position of the suction cup blocks the track in an upward position, releases power to the vehicles, and removes blockage of the track simultaneously.

U.S. Pat. No. 3,565,430 to McRoskey sets forth a drag strip racing game including a general organization of a track and gear shift type control means including a light sequencing arrangement for controlling the sequencing of the associated yellow and green signals on a starting line that is incorporated herein by reference. The patent is of interest relative to the general organization but lacks the refinements and details of the solenoid controlled checkered flags and parachute arrangements as well as the "burn-out" area of the instant invention.

As such, it may be appreciated that there is continuing need for a new and improved drag race simulation game that includes the various aspects of the sport that has heretofore not been included in a drag race simulation game and therefore the instant invention substantially fulfills this need.

SUMMARY OF THE INVENTION

In view of the foregoing disadvantages inherent in the known types of drag racing simulation devices now present in the prior art, the present invention provides a electric drag strip apparatus wherein the same includes the features of a "burn-out" area, sequencing starting light, checkered flag indicated for finish line, and parachute speed arresting devices. As such, the general purpose of the present invention, which will be described subsequently in greater detail, is to provide a new and improved electric drag strip apparatus which has all the advantages of the prior art drag strip simulation devices and none of the disadvantages.

To attain this, the present invention includes a transformer rectifier to provide direct current to an associated drag strip track with a simulation control tower, a plurality of troughs to provide a staging or burn-out area, a sequencing light inlcuding the yellow and red sequencing associated with a drag strip forum, a solenoid actuated pivoting flag to indicate a winner, and a parachute associated with each miniature vehicle to arrest forward motion of the vehicle and simulate a similar event occurring within a conventional drag strip forum.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence to the technical disclosure of the application. The abstract is neither intended to define the invention of the application, which is measured by the claims, nor is it intended to be limiting as to the scope of the invention in any way.

It is therefore an object of the present invention to provide a new and improved electric drag strip apparatus which has all the advantages of the prior art electric drag strip apparatus and none of the disadvantages.

It is another object of the present invention to provide a new and improved electric drag strip apparatus which may be easily and efficiently manufactured and marketed.

It is a further object of the present invention to provide a new and improved electric drag strip apparatus which is of a durable and reliable construction.

An even further object of the present invention is to provide a new and improved electric drag strip apparatus which is susceptible of a low cost of manufacture with regard to both materials and labor, and which accordingly is then susceptible of low prices of sale to the consuming public, thereby making such drag strip apparatus economically available to the buying public.

Still yet another object of the present invention is to provide a new and improved electric drag strip apparatus which provides in the apparatuses and methods of the prior art some of the advantages thereof, while simultaneously overcoming some of the disadvantages normally associated therewith.

Still another object of the present invention is to provide a new and improved electric drag strip apparatus utilizing the features of a control tower, staging area, pivoting checkered flag, and parachute attaching means to fully simulate a drag strip event.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is an orthographic view taken in elevation of a schematic illustration of the solenoid actuated linkage actuating the signal flag of the instant invention.

DESCRIPTION OF THE PREFERRED EMBODIMENT

Figure 1:
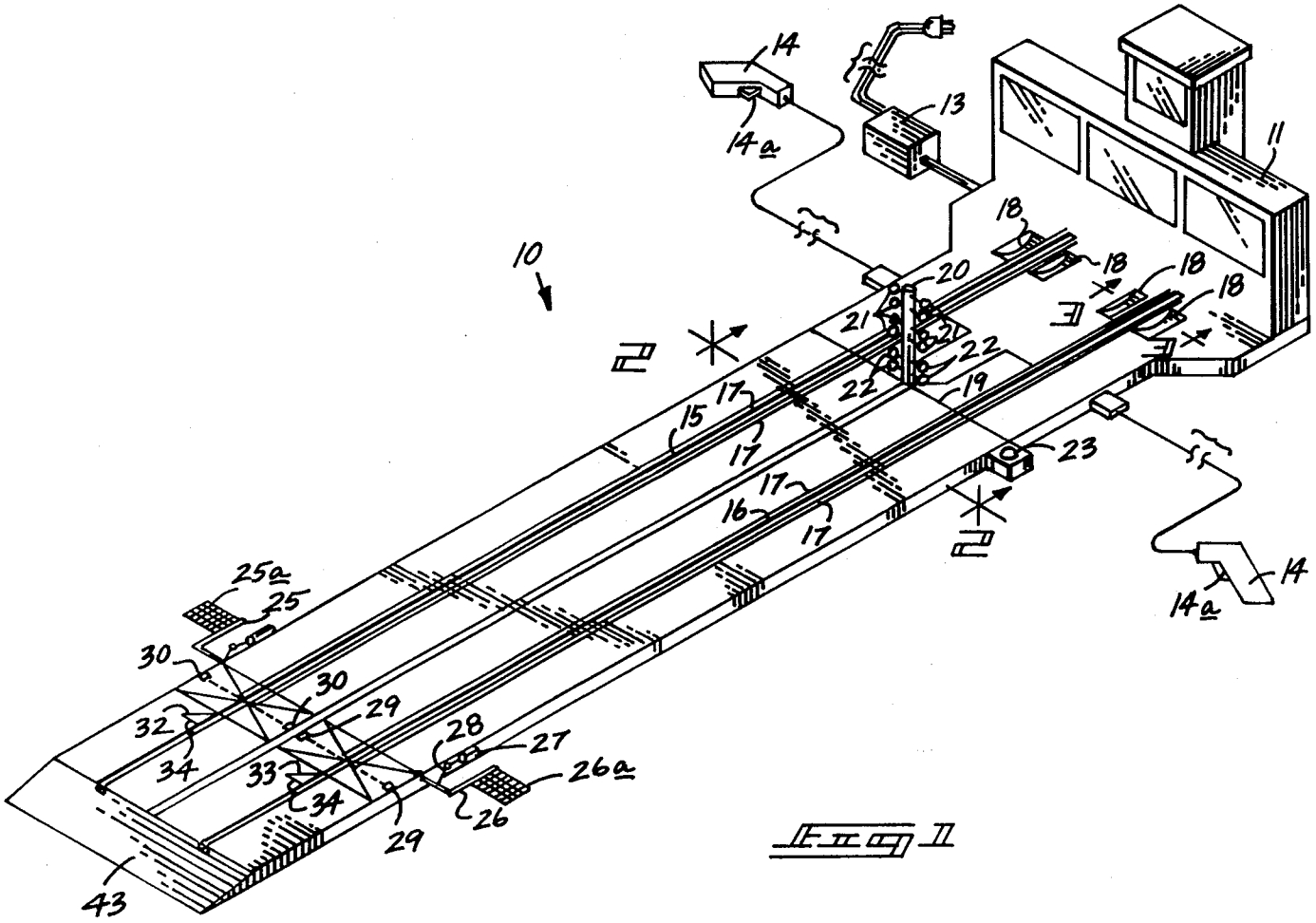
FIG. 1 is an isometric illustration of the instant invention.
Figure 2:
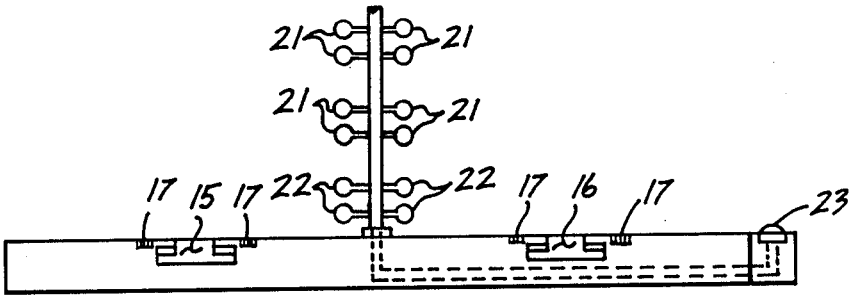
FIG. 2 is an orthographic view of the instant invention taken along the lines 2—2 of FIG. 1.

With reference now to the drawings, and in particular to FIGS. 1 to 13 thereof, a new and improved electric drag strip apparatus embodying the principles and concepts of the present invention and generally designated by the reference numeral 10 will be described.

More specifically, it will be noted that the electric drag strip apparatus 10 essentially comprises an elongate support platform 12 formed with rearwardly oriented and orthogonally secured control tower 11 at a rear terminal end thereof for simulation of the drag strip event. A transformer and rectifier 13 supplies electrical power controlled by individual control handles 14 associated with each track set forth as first elongate track 15 and second elongate track 16. Each control handle includes a resiliently biased rheostat switch 14*a* of conventional construction. The elongate tracks 15 and 16 are formed as inverted "T" shaped grooves coextensive with the upper surface of the support platform 12. Each elongate track 15 and 16 includes a pair of electrical contact rails 17 positioned and parallel to either side of the respective track 15 and 16. The contact rails provide electrical energy to an associated miniature car utilized with the instant invention of conventional and well known construction.

Figure 3:
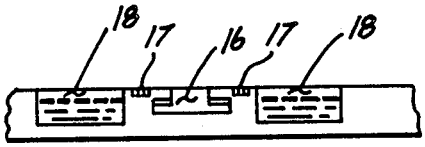
FIG. 3 is an orthographic view of the instant invention taken along the lines 3—3 of FIG. 1.
Figure 4:
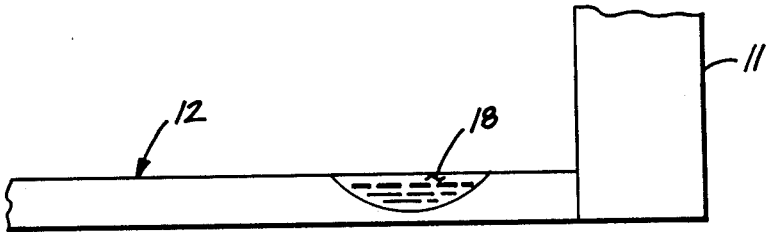
FIG. 4 is an orthographic cross-sectional view of a "burn-out" trough as utilized by the instant invention.

Positioned within an upper surface of the support platform 12 are a plurality of semi-cylindrical trough portions 18 oriented on either side and in parallel relationship to each other and to the respective first and second elongate tracks 15 and 16 and elongate electrical ocontact rail 17. Reference to FIGS. 3 and 4 illustrate the troughs 18 positioned exteriorly and parallel to the aligned track and contact rail arrangement. The troughs 18 may be filled with a suitable fluid, such as water, wherein a miniature car may be positioned and arranged on the respective track 16 for example and enable the respective wheels of the associated car to be positioned within the troughs 18 to simulate a wheel spinning condition comparable to that as may be viewed in a contemporary drag strip. Accordingly, the troughs 18 to either side of a respective rail are spaced a distance equal to the spacing of the wheels on an associated miniature car.

A starting line 19 is etched or imprinted orthogonally relative to the elongate tracks 15 and 16 wherein medially of the starting line 19 is positioned a light indicator pole 20. The pole 20 includes a plural pair of yellow lights 21 associated with each track 16 and a lowermost pair of green lights 22. A start button 23 initiates the sequence through a sequencer 24 whereupon the respective pairs of yellow lights 21 will flash until the green light pair are illuminated to indicate a start condition for cars associated and positioned within the respective tracks 15 and 16. A sequencer of conventional construction may be utilized or recourse may be had to the U.S. Pat. No. 3,565,430 illustrating such use of sequencing which is incorporated herein by reference.

Figure 9:
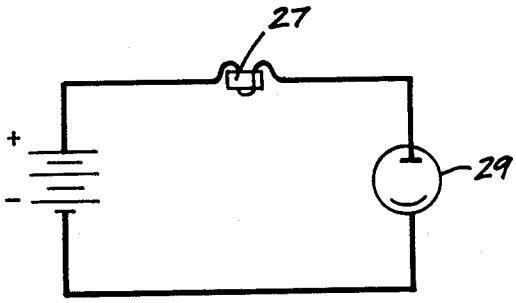
FIG. 9 is a schematic illustration of a control circuit as utilized to actuate the solenoid controlled signal flag of the instant invention.
Figure 12:
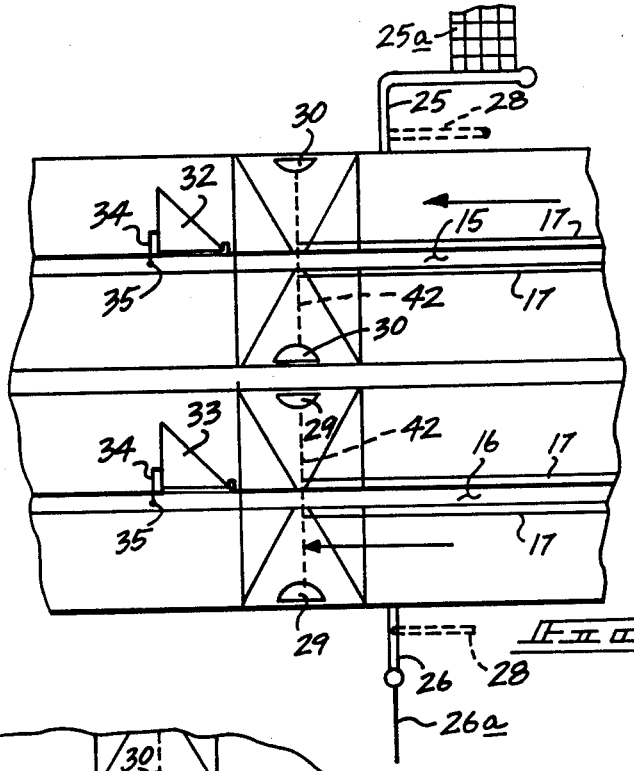
FIG. 12 is a top orthographic view of the finish line of the instant invention with one of the signal flags in a raised position.
Figure 13:
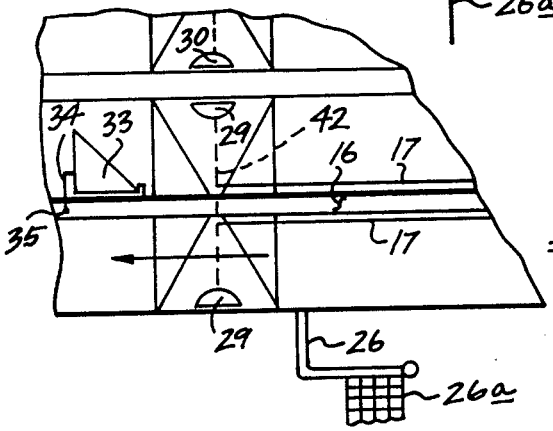
FIG. 13 is a top plan schematic illustration of a partial section of the finish line of the instant invention showing one of the signal flags in a lowered position.

A first and second "L" shaped flag link 25 and 26 respectively are pivotally mounted within side surfaces of the support platform 12 and oriented adjacent a finish line 42 etched or imprinted to indicate a finish line on the top surface of the platform 12. A solenoid 27 is associated with each "L" shaped flag link to pivot the flag link from a first horizontal position, as illustrated in FIGS. 1 and 13 for example, to a second vertical position, as illustrated in FIG. 12 for example. The solenoid 27 operates through a link 28 that is pivotally connected to the solenoid rod by a pivotal mount which in turns pivots the flag link 28 to orient the respective first and second flags 25*a* and 26*a* to a vertical orientation. A first photo-eye and light source pair 29 operates through an individual circuit, as illustrated in FIG. 9, to actuate an associated flag 26a to a vertical position with a second photo-eye and light source pair 30 associated with the second flag 26a to orient the second flag to a vertical position whereupon a miniature vehicle breaking the light beam across a respective pair of photo-eyes will actuate the respective solenoid 27 to pivot a flag from a first to a second position.

Figure 5:
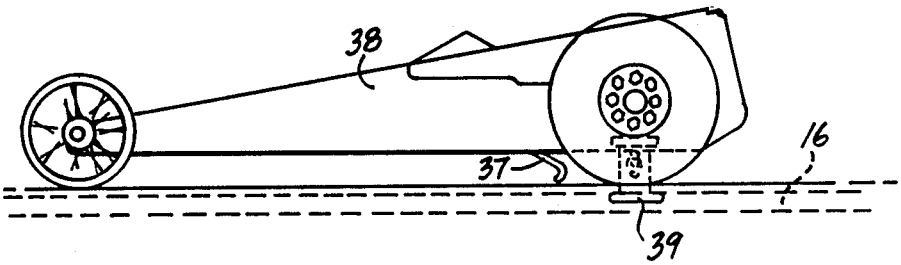
FIG. 5 is an orthographic view taken in elevation of a miniature car utilized by the instant invention in a first position.
Figure 6:
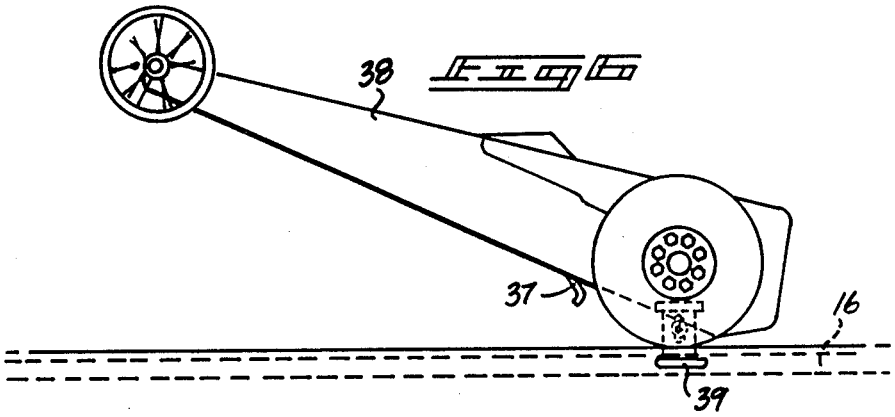
FIG. 6 is an orthographic view taken in elevation of a minature car utilized by the instant invention in a second position.
Figure 7:
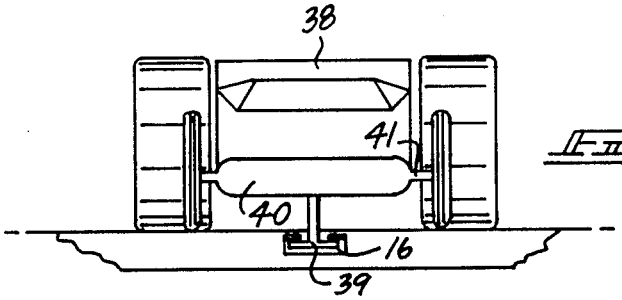
FIG. 7 is a rear orthographic view taken in elevation of a miniature car as utilized by the instant invention.
Figure 8B:
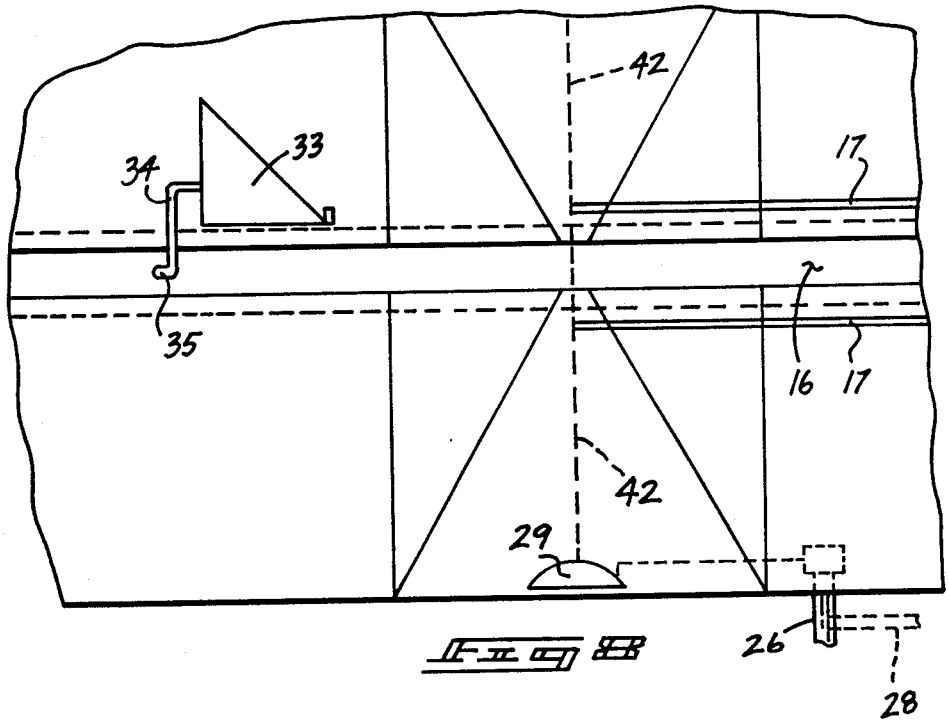
FIG. 8 is a top plan view of a finish line of the instant invention.

The electrical contact rails 17 terminate at the finish line 42 whereupon power thereby is shut off and thereafter a vehicle utilizing the instant invention, as illustrated in FIGS. 5, 6, and 7, employs a car hook 37 to engage a parachute hook 35. The parachute hook 35 is vertically oriented relative to a horizontally disposed "L" shaped parachute link 34 that is secured to a respective parachute 36. The parachutes 36 are positioned within respective first and second pivotally mounted parachute doors 32 and 33 positioned on the top surface of the platform 12 overlying respective parachute cavities formed within a top surface of the platform 12.

The car 38 further utilizes a contact shoe 39 of generally "T" shaped configuration mounted to an axle housing 40 pivotally secured about an axle 41 of the respective car 38. In this manner a car upon receiving full electrical communication through the respective switch 14a which are typically rheostat type switches, may allow a car, as illustrated in FIG. 6, to pivot upwardly in a fashion as may be found in contemporary drag strips.

Figure 11:
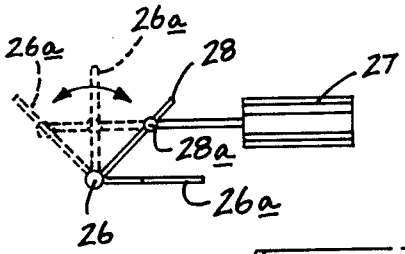
FIG. 11 is an orthographic view taken in elevation of the parachute securement means of the instant invention.
Figure 11:
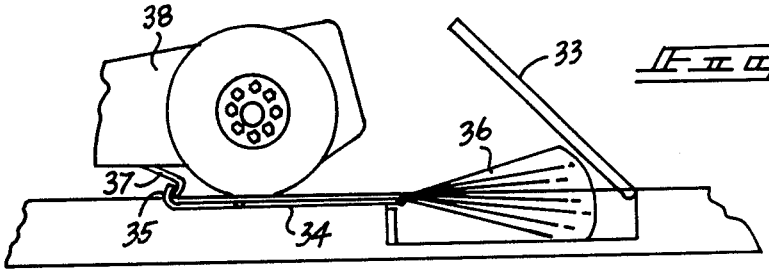

Accordingly, a car 38 crossing the finish line 42 will break a respective photo-cell and light source pair either 29 or 30 and thereafter engage a respective parachute 36 by means of the car hook 37 engaging the associated parachute 35, as illustrated in FIG. 11 for example.

The platform 12 terminates in a beveled exit ramp 43 oriented orthogonally relative to the respective first and second tracks 15 and 16 and the elongate dimension of the platform 12 to enable to smooth transition of the cars from the platform surface 12 to a support surface upon which the platform 12 is disposed.

As to the manner of usage and operation of the instant invention, the same should be apparent from the above disclosure and accordingly no further discussion relative to the manner of usage an operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electrical drag strip apparatus to provide a contest between two individuals, each racing a miniature vehicle, said apparatus comprising, an elongate support platform means including first and second tracks each adapted to accept a downwardly depending shoe secured to each of said two vehicles, and at least one electrical conductor coextensive and parallel to each of said elongate tracks, and a finish line orthogonally oriented to said first and second tracks and each electrical conductor wherein each electrical conductor terminates at said finish line and each of said first and second tracks extends beyond said finish line to a terminal end of said platform means, and a starting line orthogonally directed and formed across said first and second tracks rearwardly spaced to and parallel of said finish line with a starting indicator medially positioned of said starting line, and a pair of spaced troughs associated with each of said first and second tracks with each pair of troughs positioned exteriorly of a respective track and a respective electrical conductor wherein said troughs are positioned and spaced rearwardly of said starting line to accept a fluid within said troughs.

2. An electrical drag strip apparatus as set forth in claim 1 wherein a first and second pivoting flag is pivotally mounted adjacent said finish line and is positionable from a first horizontal position to a second vertical position, and a photo-electric eye and light source pair associated with each of said first and second flags whereupon one of said miniature vehicles passing between a respective photo-electric eye and light source pair energizes a solenoid associated with each of said flags to pivot a respective flag from a first horizontal position to a second vertical position to indicate passage across said finish line.

3. An electrical drag strip apparatus as set forth in claim 2 wherein said photo-electric eye and light source pairs are aligned with said finish line.

4. An electrical drag strip apparatus as set forth in claim 3 wherein a start button is associated with said starting indicator to sequentially illuminate a series of lights positioned vertically on said starting indicator.

5. An electrical drag strip apparatus as set forth in claim 4 wherein a beveled exit ramp is secured to said terminal end of said platform means to provide a gradual elevational change from an upper platform surface to a support surface supporting said electric drag strip apparatus.

6. An electrical drag strip apparatus as set forth in claim 5 wherein a parachute is positionable within a recessed compartment formed within an upper surface of said platform means with a hook associated with each parachute, and said hook is engageable within a car hook associated with each miniature vehicle whereupon a miniature vehicle passing said finish line engages said hook to couple said parachute to said vehicle.

7. An electrical drag strip apparatus as set forth in claim 6 wherein a door is pivotally mounted over said compartment to secure a parachute prior to engagement by a minature vehicle.

8. An electrical drag strip apparatus as set forth in claim 7 wherein each downwardly depending shoe associated with each miniature vehicle is mounted to an axle housing pivotally mounted to each axle of each miniature vehicle to enable pivot-ng of said miniature vehicle about a rear axle.

* * * * *